US005192891A

United States Patent [19]

Matsuura et al.

[11] Patent Number: 5,192,891

[45] Date of Patent: Mar. 9, 1993

[54] METAL HALIDE LAMP

[75] Inventors: Atsushi Matsuura; Shinji Inukai; Hisanori Sano, all of Kanagawa, Japan

[73] Assignee: Toshiba Lighting & Technology Corporation, Tokyo, Japan

[21] Appl. No.: 817,649

[22] Filed: Jan. 7, 1992

[30] Foreign Application Priority Data

Jan. 11, 1991 [JP] Japan ..... 3-18226

[51] Int. Cl.[5] ..... H01J 61/20; H01J 61/22; H01J 61/34

[52] U.S. Cl. ..... 313/25; 313/639

[58] Field of Search ..... 313/639, 25

[56] References Cited

U.S. PATENT DOCUMENTS

| | | | |
|---|---|---|---|
| 3,566,178 | 2/1971 | Mori et al. | 313/639 |
| 3,882,345 | 6/1975 | Kazek et al. | 313/639 |
| 4,001,626 | 1/1977 | Drop et al. | 313/639 X |
| 4,717,852 | 1/1988 | Dobrusskin et al. | 313/25 |

FOREIGN PATENT DOCUMENTS 412870 7/1964 Japan .

*Primary Examiner*—Palmer C. DeMeo

*Attorney, Agent, or Firm*—Cushman, Darby & Cushman

[57] ABSTRACT

A metal halide lamp comprises a glass tube defining a discharge space and a pair of electrodes provided in the glass tube for generating a discharge therebetween. The metal halide lamp has mercury and halogen fillings comprising bromine and iodine contained in the glass tube. The mol ratio of the bromine to the halogen fillings is 0.3 to 0.7. The metal halide lamp has metal reacting with the halogen and emitting light in the glass tube by the discharge. The metal comprises tin, sodium, thallium and indium. The tin contained in the glass tube is at the amount of 1 to 14 μ·mol per 1 cc of discharge space. Each mol ratio of the amount of the sodium, the thallium and the indium to the amount of the tin is not less than 0.2, respectively. The lamp has a color temperature of more than 4000° K. without sacrificing efficiency or color rendition.

15 Claims, 6 Drawing Sheets

METAL HALIDE LAMP

BACKGROUND OF THE INVENTION

1. Field of the Invention

The present invention relates to a metal halide discharge lamp, and more particularly, to a metal halide discharge lamp using tin as a metal emitting visible light.

2. Description of the Related Art

There have been known many kinds of metal halide lamps using at least one kind of metal emitting visible light. It is known to build a small sized single ended metal halide lamp. It has a pair of electrodes positioned at one side of a light emitting tube. It has a high wall load of not less than 25 W/cm$^2$ for emitting a high intensity light. The wall load is much greater than those of metal halide lamps of the type which have a pair of electrodes which are located at respective opposite ends of the light emitting tube which have a wall load of 10 to 18 W/cm$^2$.

The metal halide lamp having a high wall load can not use rare earth metals, such as dysprosium, which have high efficiency in emitting light and have high color rendition of light. When a lamp has a high wall load, the temperature of the light emitting tube increases and dysprosium is likely to react with quartz which is a material of the light emitting tube at high temperature. When dysprosium reacts with the light emitting tube made of quartz, the light emitting tube can not transmit light and dysprosium decreases. Therefore, metal halide lamps having a high wall load use other metals for emitting visible light such as thallium, sodium, tin, mercury and so on, as shown in U.S. Pat. No. 4,717,852. Tin emits visible light having high color rendition. Thallium and sodium are used for improving the efficiency and the color rendition of light.

However, the metal halide lamp not using dysprosium has a correlative color temperature (which will be called "clcolor temperature" in the below) of about 3000° K. It is too low, as compared with a color temperature of 4000 to 5000° K. which the metal halide lamp has by using dysprosium.

It is known to use metals emitting more blue or green light for increasing a color temperature of a metal halide lamp having a low wall load. However, when the same technology is applied to a metal halide lamp having a high wall load, it does not overcome the problem of decreased efficiency or color rendition because of difference in wall load.

SUMMARY OF THE INVENTION

It is an object of the present invention to increase a color temperature without decreasing efficiency or color rendition of a metal halide lamp having a high wall load.

To accomplish this object, the present invention provides a metal halide lamp including a glass tube defining a discharge space and a pair of electrodes provided in the glass tube for generating a discharge therebetween. The metal halide lamp has mercury and halogen fillings comprising bromine and iodine contained in the glass tube. The mol ratio of the bromine to the halogen fillings is 0.3 to 0.7. The metal halide lamp has various metals reacting with the halogen for emitting light in the glass tube as a result of the discharge. These metals include tin, sodium, thallium and indium. The tin contained in the glass tube is at the amount of 1 to 14 $\mu$·mol per 1 cc of discharge space. Each mol ratio of the amount of the sodium, the thallium and the indium to the amount of the tin is not less than 0.2, respectively.

BRIEF DESCRIPTION OF THE DRAWINGS

The present invention will be better understood with reference to accompanying drawings, wherein same reference numerals throughout the various figures denote similar structural elements and in which.

DETAILED DESCRIPTION OF THE PREFERRED EMBODIMENTS

Preferred embodiments of the present invention will now be described in more detail with reference to the accompanying drawings.

Figure 1:
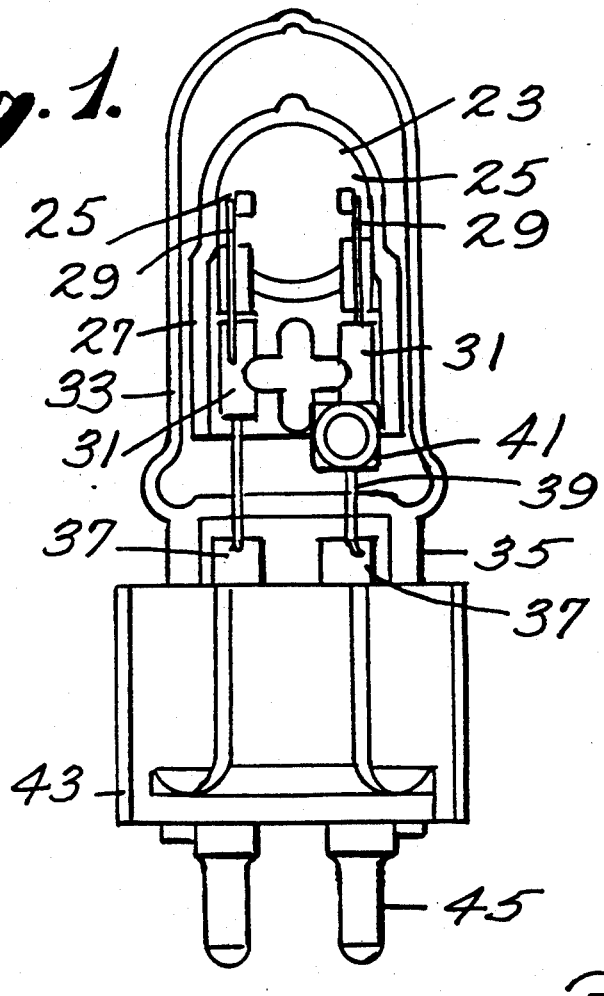
FIG. 1 is a front view of a single ended metal halide lamp according to the present invention.

FIG. 1 shows a configuration of a metal halide lamp according to the present invention. The metal halide lamp has a discharge glass tube 21 made of quartz glass. Discharge glass tube 21 defines a discharge space 23 of 1.3 mm in inner diameter. Discharge space 23 has a volume of 1.2 cc. Discharge glass tube 21 has a pair of electrodes 25, 25 within discharge space 23 for generating the discharge. Electrodes 25, 25 are about 6 mm apart from one another and are made from tungsten wires which are wound around the tops of inner lead wires 29, 29. The tungsten of electrodes 25, 25 contains thorium of 2 wt % Thermal capacity of electrodes 25, 25 increases by winding. The thermal capacity of electrodes 25, 25 is determined in large part by the number of windings of the tungsten wire. Inner lead wires 29, 29 are made of rhenium or rhenium-tungsten alloy and are bent near electrodes 25, 25.

Discharge glass tube 21 has a pinch seal portion 27 for supporting inner lead wires 29, 29. Pinch seal portion 27 is formed at one end of discharge tube 21 located in a direction which is perpendicular to the direction of the discharge. Pinch seal portion 27 comprises parallel molybdenum foils 31, 31 for connecting electrodes 25, 25 with the operating circuit.

Discharge glass tube 21 is surrounded by outer glass tube 33. Outer glass tube 33 forms second pinch seal portion 35 at one side of outer glass tube 33 located in the direction perpendicular to the discharge direction. Second pinch seal portion 35 is close to pinch seal portion 27 of discharge glass tube 21. Second pinch seal portion 35 comprises second foils 37, 37 for connecting electrodes 25, 25 with the operating circuit by medium lead wires 39, 39. Medium lead wires 39, 39 connect directly to foils 31, 31 of discharge glass tube 21 and second foils 37, 37 of outer glass tube 33. Medium lead wires 39, 39 support discharge glass tube 21 and getter material 41 for absorbing undesirable gas elements in outer glass tube 33.

Second pinch seal portion 35 is inserted in base 43 having a pair of terminal pins 45, 45. Pins are electrically connected with second foils 37, 37 by outer lead wires (not shown). Pins 45, 45 are to be connected with the operating circuit.

An operating circuit supplies a power of 150 W to the lamp and therefore, the wall load of discharge glass tube 21 is 28 W/cm$^2$.

Discharge glass tube 21 has a certain amount of mercury for generating a discharge. A rare gas such as argon is provided to facilitate a start of discharge. Various metal halides are provided for emitting visible light at various wavelengths. The metals are tin, sodium, thallium and indium. The tin is provided in the discharge glass tube in the amount of 1 to 14 $\mu$·mol per 1 cc of discharge space. Each mol ratio of the amount of the sodium, the thallium and the indium to the amount of the tin is not less than 0.2, respectively. The halogens of the metal halides include bromine and iodine. The mol ratio of the bromine to the halogen fillings is 0.3 to 0.7.

The amount or ratio of metals and halide are determined based upon the results of the experiments and considerations of inventors, as follows.

It is known that thallium emits greenish light, indium emits bluish light and sodium emits yellowish light in a metal halide lamp having a low wall load. The color temperature of the metal halide lamp is a function of the mol ratio of metals. However, when the wall load becomes higher, the ratio of each light emitted from the metal varied, according to the wall load. Especially, when the wall load is more than 25 W/cm$^2$, sodium more strongly emits yellowish light and tin more strongly emits many kinds of light in color, as compared with the lamp having less than 18 W/cm$^2$ in wall load.

Based on this discovery, many kinds of experiments were made to investigate relationships among efficiency, color temperature, color rendition, amount of tin in discharge tube 21, the mol ratio of the other metals to the amount of tin and the mol ratio of the bromine to the halogen. The brief results about effects of parameters varying are shown in TABLE 1. Details of each experiment will be described in the following.

TABLE 1

Figure 2:
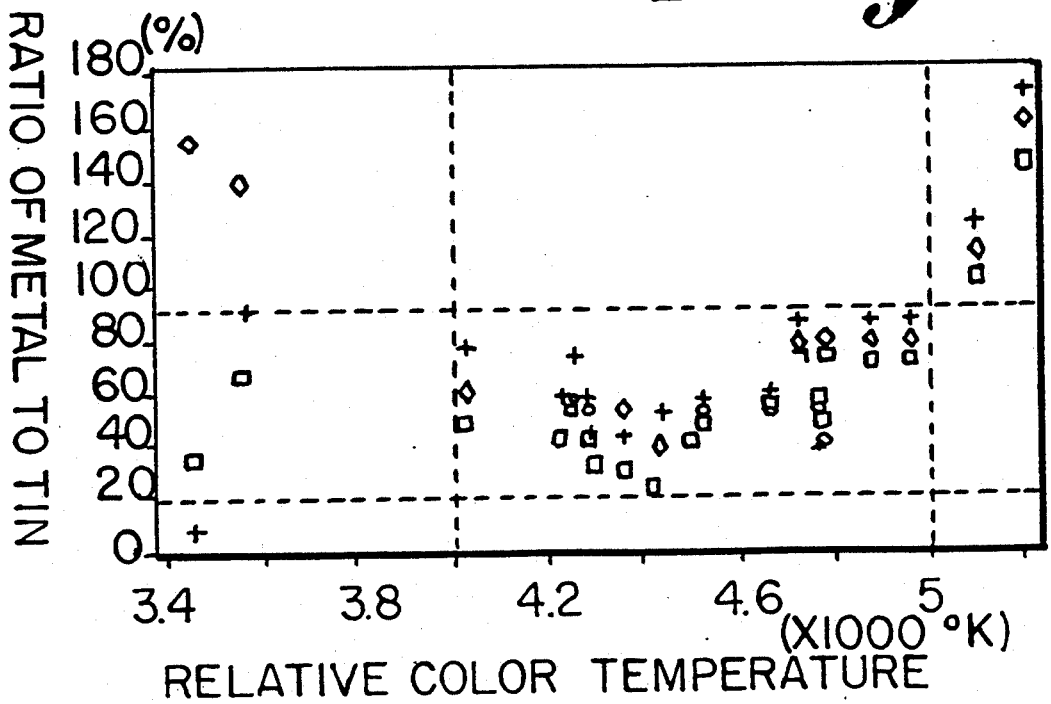
FIG. 2 is a graph showing a relationship between the mol ratio of metals and a color temperature in the metal halide lamp having a high wall load.
Figure 3:
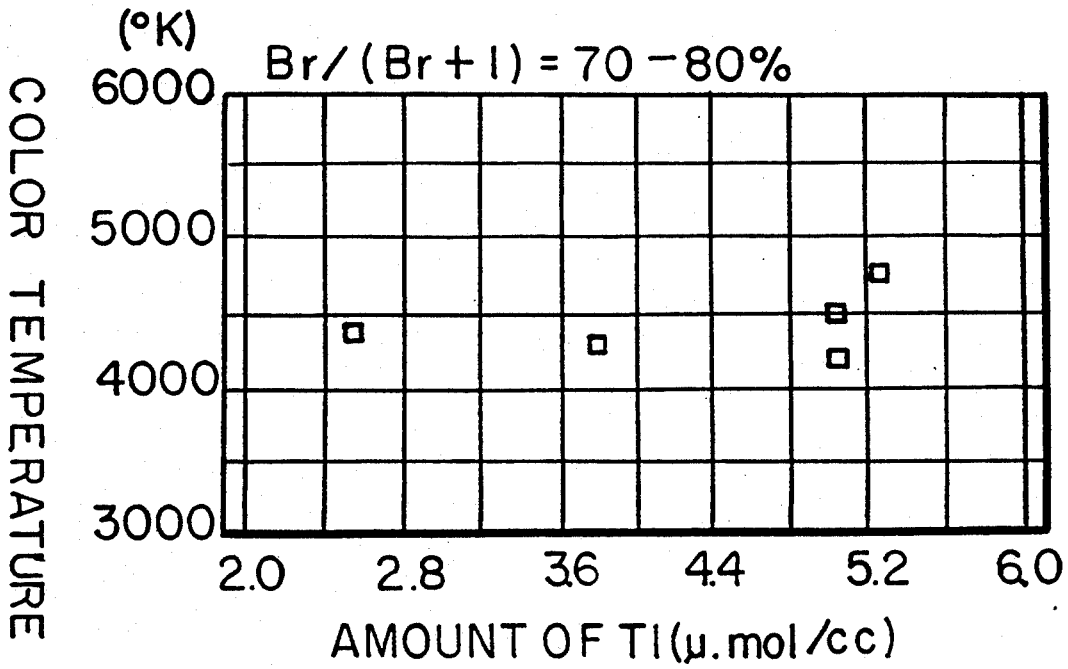
FIG. 3 is a graph showing a relationship between the amount of thallium and the color temperature of the lamp.
Figure 4:
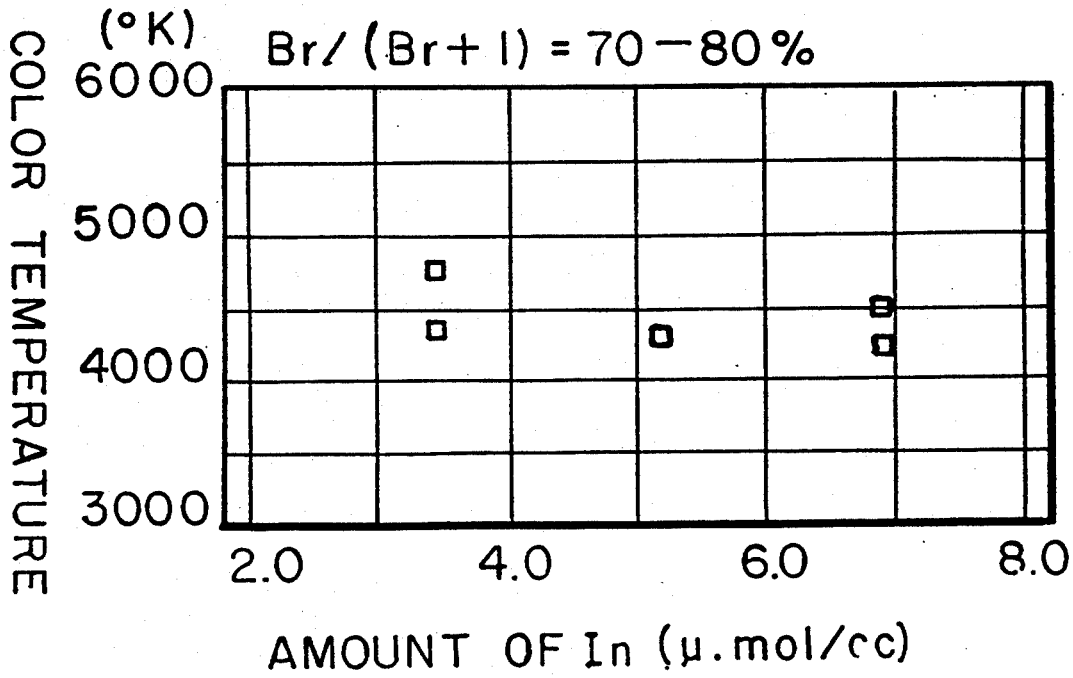
FIG. 4 is a graph showing a relationship between the amount of indium and the color temperature of the lamp.
Figure 6:
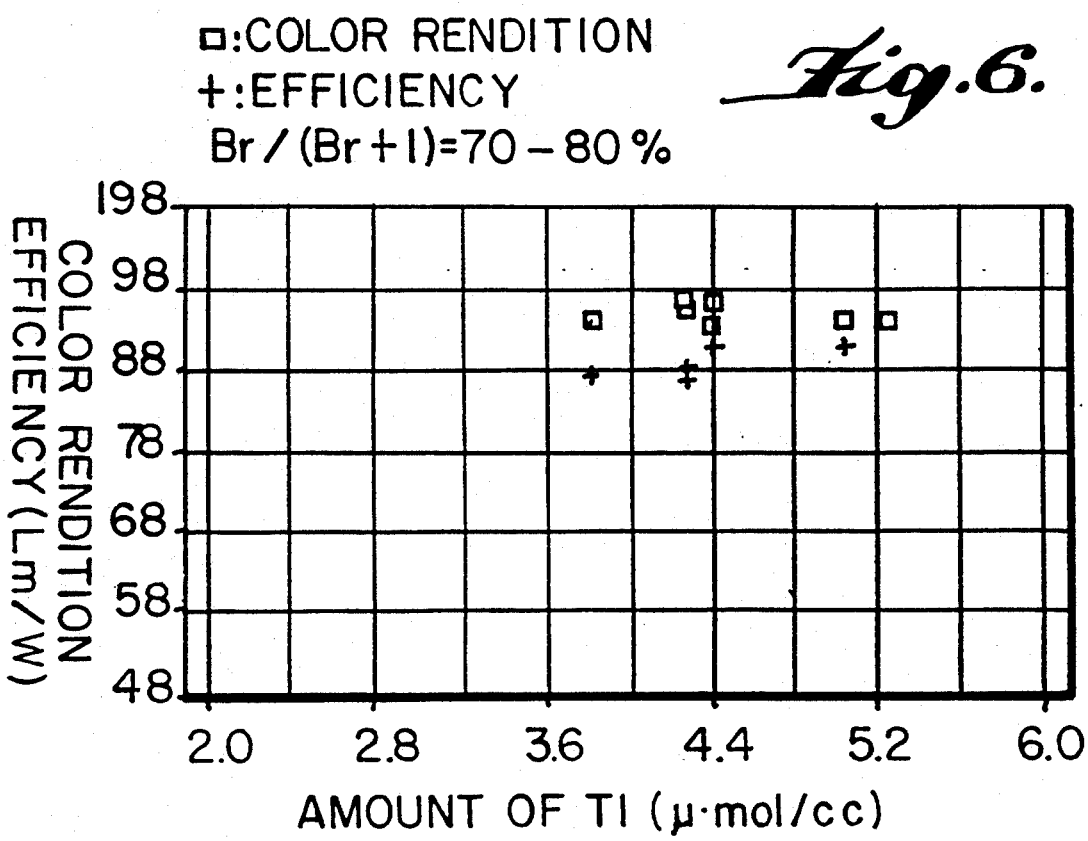
FIG. 6 is a graph showing a relationship between the amount of thallium and the color rendition and the efficiency of the lamp.
Figure 7:
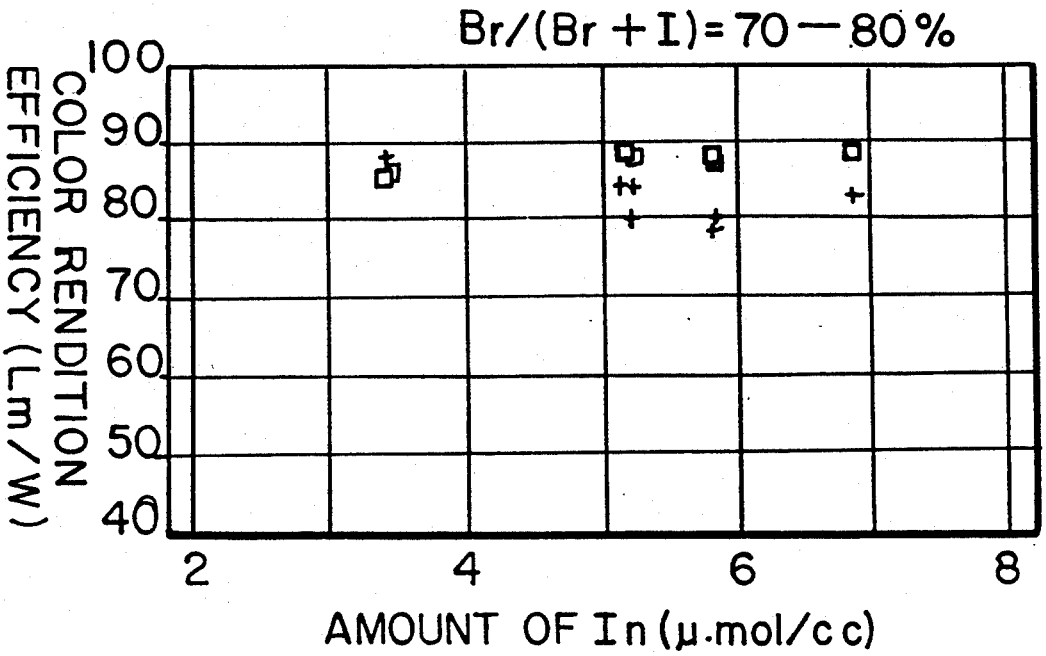
FIG. 7 is a graph showing a relationship between the amount of indium and the color rendition and the efficiency of the lamp.
Figure 8:
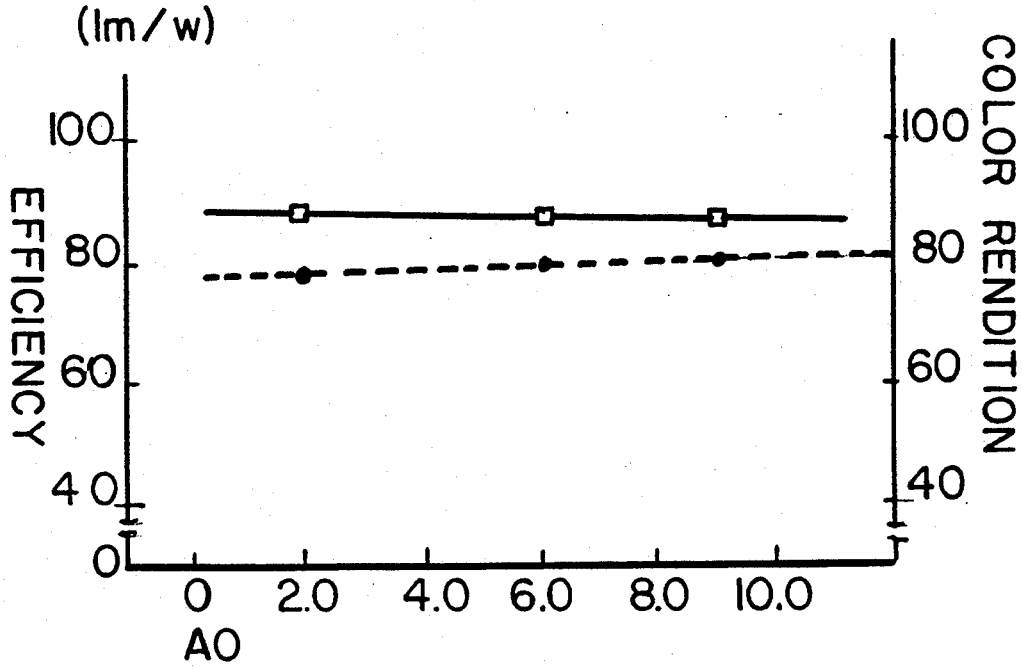
FIG. 8 is a graph showing a relationship between the amount of sodium and the color rendition and the efficiency of the lamp.
Figure 9:
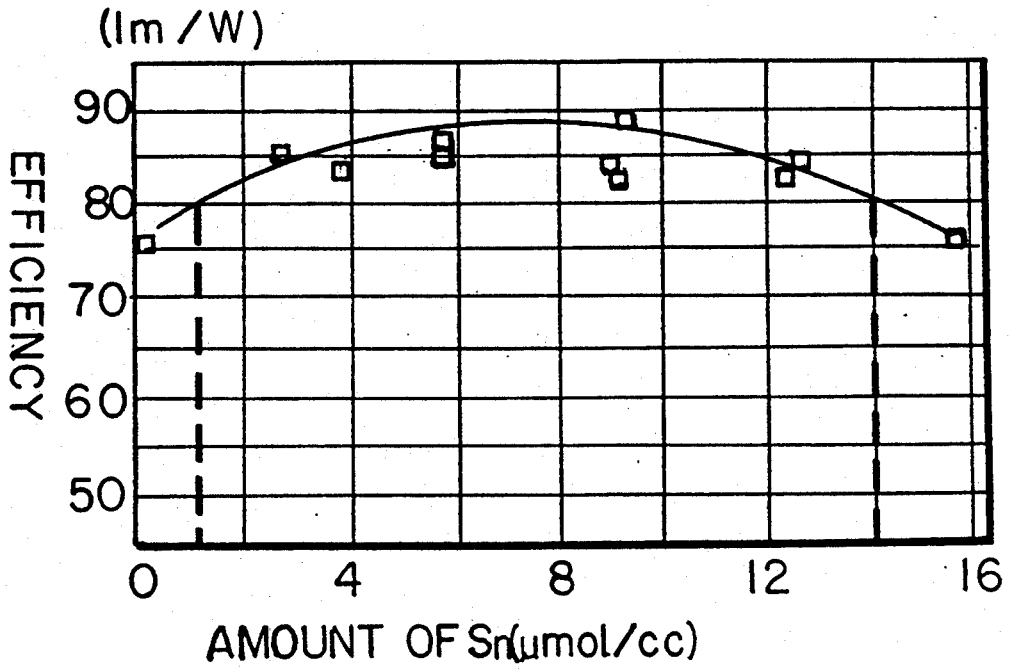
FIG. 9 is a graph showing a relationship between the amount of tin and the efficiency of the lamp.
Figure 10:
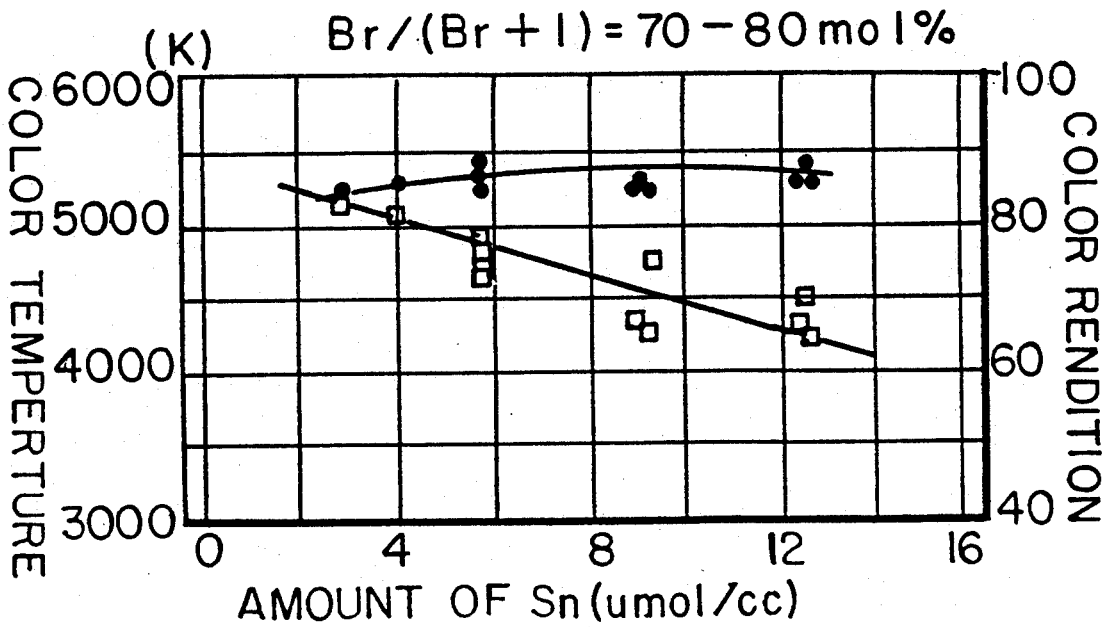
FIG. 10 is a graph showing a relationship between the amount of tin and the color rendition and the color temperature of the lamp.
Figure 11:
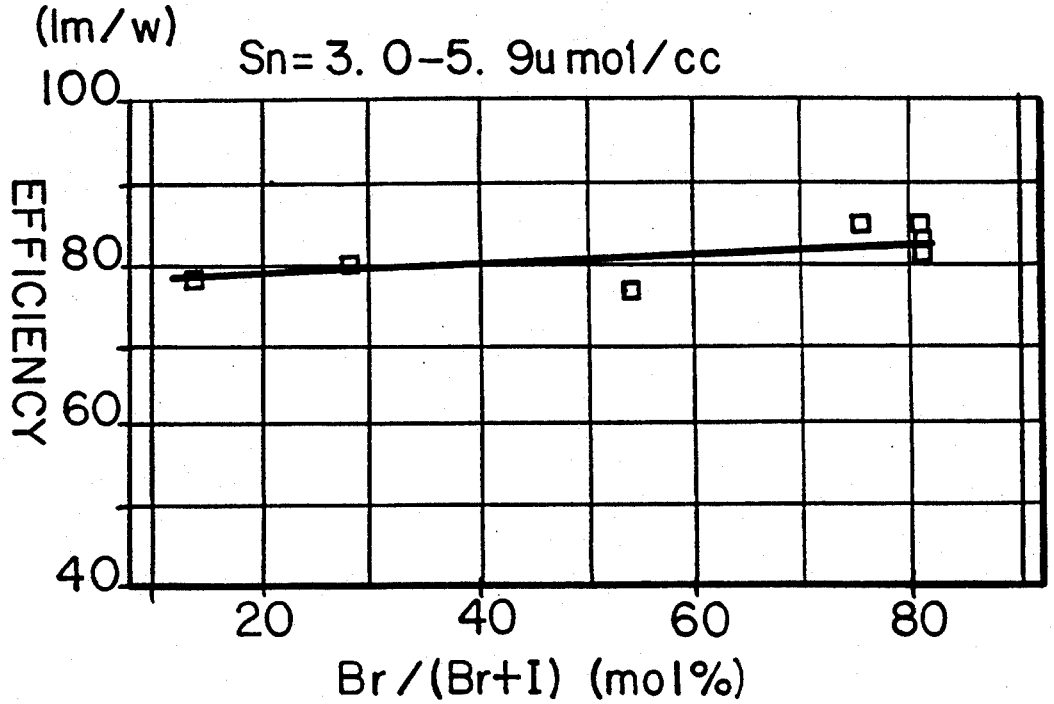
FIG. 11 is a graph showing a relationship between the ratio of the bromine to the halogen and the efficiency of the lamp.
Figure 12:
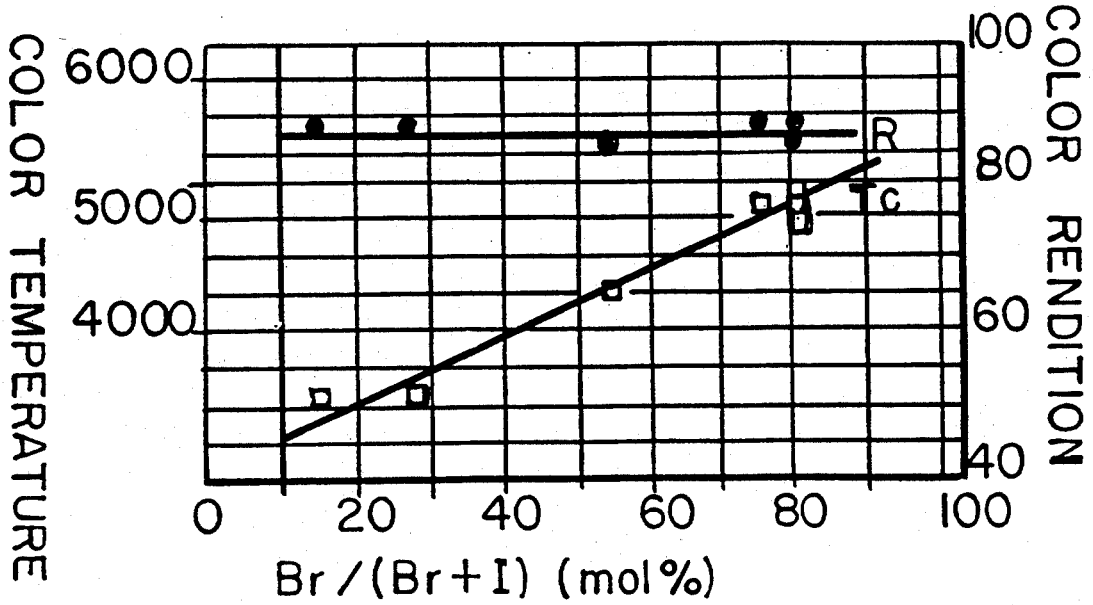
FIG. 12 is a graph showing a relationship between the ratio of the bromine to the halogen and the color rendition and the color temperature of the lamp.

| | Color Temperature | | Efficiency | | Color Rendition | |
|---|---|---|---|---|---|---|
| | Result(s) | Effect | Result(s) | Effect | Result(s) | Effect |
| Ratio of Metal | FIGS. 2, 3, 4 & 5 | Large | — | — | — | — |
| Amount of Sn | FIG. 11 | Large | FIG. 9 | Large | FIG. 10 | Small |
| Amount of Tl | — | — | FIG. 6 | Medium | FIG. 6 | Small |
| Amount of In | — | — | FIG. 7 | Small | FIG. 7 | Small |
| Amount of Na | — | — | FIG. 8 | Small | FIG. 8 | Small |
| Ratio of Br | FIG. 12 | Large | FIG. 11 | Small | FIG. 12 | Small |

First of all, a relationship between the mol ratio of thallium, indium and sodium to tin and a color temperature was measured, changing the mol ratio of thallium, indium and sodium to tin. The result is shown in FIG. 2. The vertical axis represents the mol ratio of the metals used in discharge glass tube 21 and the horizontal axis represents the color temperature. The lamps measured and shown in FIG. 2 were set in the range of 0.4 to 1.8 $\mu$·mol of tin per 1 cc of discharge space and 0.7 to 0.8 in the mol ratio of the bromine to the halogen in mol ratio, for decreasing effects of difference in amount of tin and in mol ratio of the bromine to the halogen.

According to the experimental results plotted in FIG. 2, the mol ratio of the other metals to tin is significant in determining the color temperature of the metal halide lamp having high wall load. It is necessary that the mol ratio of each metal of thallium, indium and sodium to tin be not less than 0.2 in mol ratio so that the color temperature of the lamp will be more than 4000° K. It is necessary that the mol ratio of each metal of thallium, indium and sodium to tin be in the range of 0.2 to 0.9 in mol ratio so that the lamp has a color temperature of 4000 to 5000° K.

Figure 5:
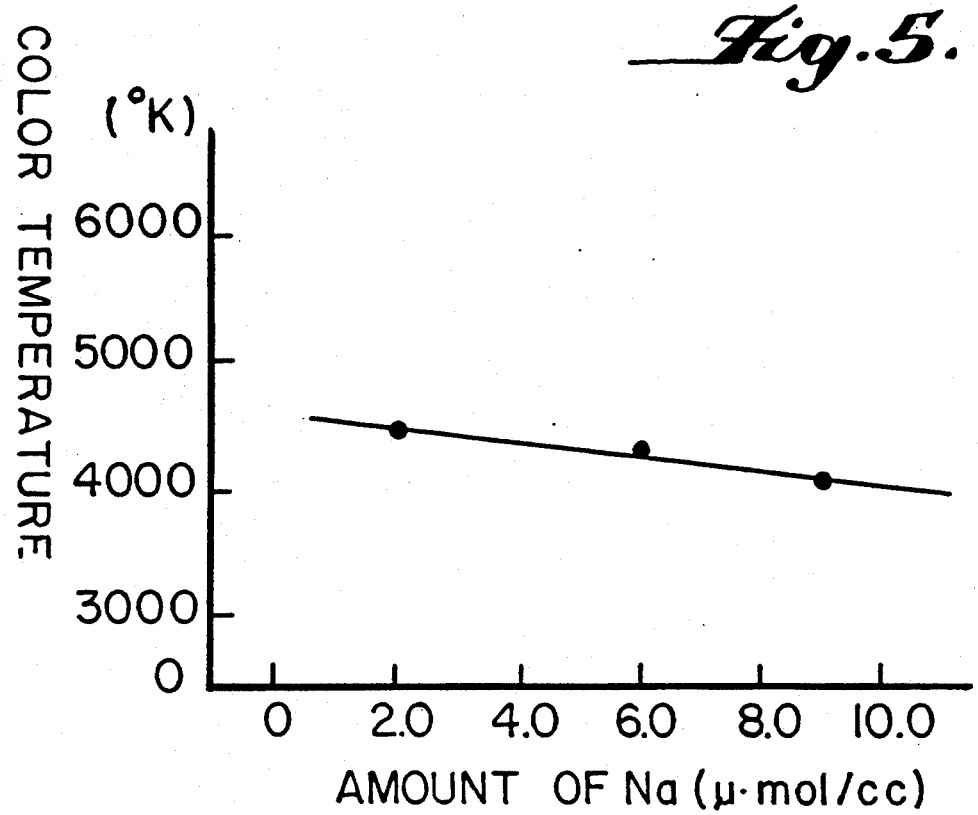
FIG. 5 is a graph showing a relationship between the amount of sodium and the color temperature of the lamp.

The relationships between the amount of thallium, indium and sodium and the color temperature of lamps were measured. The results are shown in FIG. 3, FIG. 4 and FIG. 5. The horizontal axes represent amounts of thallium, indium and sodium, respectively, used in discharge glass tube 21 and the vertical axis of each represents color temperature. The lamps measured and shown in FIG. 3 and FIG. 4 were set in the range of 9.0 to 11.8 $\mu$·mol of tin per 1 cc of discharge space and 0.7 to 0.8 in the mol ratio of the bromine to the halogen, for decreasing effects of difference in amount of tin and in mol ratio of the bromine to the halogen. Further, the amount of thallium was set in the range of 2.4 to 5.2 $\mu$·mol per 1 cc of the discharge space and the amount of indium was set in the range of 3.4 to 7.0 $\mu$·mol per 1 cc of the discharge space. The amount of sodium was set at 5.8 $\mu$·mol per 1 cc of the discharge space.

The lamps measured and shown in FIG. 5 were in the range of 7.5 $\mu$·mol of tin per 1 cc of discharge space and 0.5 to 0.6 in the mol ratio of the bromine to the halogen, for the same reasons as in FIG. 3 and FIG. 4.

Accordingly, the mol ratio of the other metals to tin were in the range of not less than 0.2, actually 55% of thallium to tin and 83% of indium to tin, with regards to FIG. 3, FIG. 4 and FIG. 5.

It is shown in FIG. 3, FIG. 4 and FIG. 5, that the amount of the other metals have a large effect on the color temperature of a metal halide lamp having a high wall load because the amount of the other metals relates to the mol ratio of the other metals to tin. It is also understandable that the lamp has a color temperature of more than 4000° K. when the mol ratio of the other metals to tin is not less than 0.2.

Next, relationships among the amount of thallium, indium and sodium, efficiency and color rendition were measured. The results are plotted in FIG. 6, FIG. 7 and FIG. 8. The horizontal axes of the figures represent amounts of thallium, indium and sodium, respectively used in discharge glass tube 21. The vertical axis of each figure represents color rendition and efficiency. The lamps measured and shown in FIG. 6 and FIG. 7 had a range of 6.0 to 11.8 μ·mol of tin per 1 cc of discharge space and 0.7 to 0.8 in the mol ratio of the bromine to the halogen, for decreasing effects of difference in amount of tin and in mol ratio of the bromine to the halogen. Further, the amount of thallium was in the range of 2.4 to 5.2 μ·mol per 1 cc of the discharge space and the amount of indium was in the range of 3.4 to 7.0 μ·mol per 1 cc of the discharge space. The amount of sodium was 5.8 μ·mol per 1 cc of the discharge space.

The lamps measured and shown in FIG. 8 were in the range of 7.5 μ·mol of tin per 1 cc of discharge space and 0.5 to 0.6 in the mol ratio of the bromine to the halogen, for the same reasons as in FIG. 6 and FIG. 7.

Accordingly, the mol ratio of the other metals to tin were in the range of not less than 0.2, actually 55% of thallium to tin and 83% of indium to tin, with regards to FIG. 6, FIG. 7 and FIG. 8.

As shown in FIG. 6, FIG. 7 and FIG. 8, the mol ratio of the other metals to tin is not significant in determining the color rendition and efficiency of the metal halide lamp having a high wall load when the mol ratio of the other metals to tin is not less than 0.2.

Next, effects of the amount of tin in determining the color temperature, the efficiency and the color rendition were measured. The results are shown in FIG. 9 and FIG. 10. The horizontal axes of FIG. 9 and FIG. 10 represent the amount of tin in μ·mol per 1 cc of discharge spaces. The vertical axis of FIG. 9 represents the efficiency of the lamps. The vertical axis of FIG. 10 represents the color temperature and the color rendition of the lamps. The lamps measured and shown in FIG. 9 and FIG. 10 had the amount of 2.4 to 5.2 μ·mol/cc of thallium, the amount of 3.4 to 7.0 μ·mol/cc of indium and the amount of 5.8 μ·mol/cc of sodium. Therefore, the effects of the difference in the amount of thallium, indium and sodium were decreased. Further the lamps had the mol ratio of the other metals to tin in the range of not less than 0.2 and therefore, the lamps have a color temperature greater than 4000° K., except for the lamp not having tin. Furthermore, the lamps of FIG. 9 and FIG. 10 had the range of 0.7 to 0.8 in mol ratio of the bromine to the halogen fillings.

As shown in FIG. 9, the amount of tin is significant in determining the efficiency of the lamp. The inventors confirmed that the lamp having the amount of more than 30 μ·mol/cc of the tin has an efficiency of about 40 lm/W. Therefore, it is necessary that the amount of tin be in the range of 1.0 to 14.0 μ·mol/cc in order to obtain the efficiency of more than 80 lm/W. Further, according to FIG. 10, it is shown that the amount of tin effects color temperature Tc and does not effect color rendition Ra. Furthermore, when the amount of tin is not more than 14.0 μ·mol/cc, the lamp has a color temperature of not less than 4000° K. and when the amount of tin is not less than 5.0 μ·mol/cc, the lamp has a color temperature of not more than 5000° K.

Next, effects of the mol ratio of the bromine to the halogen fillings on color temperature, efficiency and color rendition were measured. The results are shown in FIG. 11 and FIG. 12. The horizontal axes of FIG. 11 and FIG. 12 represent the mol ratio of the bromine to the halogen fillings. The vertical axis of FIG. 11 represents the efficiency of the lamps. The vertical axis of FIG. 12 represents the color temperature and the color rendition of the lamps. The lamps measured and shown in FIG. 11 and FIG. 12 had the amount of 2.4 to 5.2 μ·mol/cc of thallium, the amount of 3.4 to 7.0 μ·mol/cc of indium, the amount of 5.8 μ·mol/cc of sodium and had the mol ratio of the other metals to tin in the range of not less than 0.2, in the same way as in FIG. 9 and FIG. 10. Further, the measured lamps had the amount of 6.0 to 11.8 μ·mol/cc of tin.

As shown in FIG. 11 and FIG. 12, the mol ratio of the bromine to the halogen fillings does not control efficiency and color rendition Ra. However, the mol ratio of the bromine to the halogen fillings does control color temperature Tc of the lamp. The lamp has a color temperature Tc between 4000° K. and 5000° K. when the mol ratio of the bromine to the halogen fillings is 30 to 70%. Accordingly, it is necessary to set the mol ratio of the bromine to the halogen fillings within the range of at least 30% in order to obtain the lamp having the color temperature of at least 4000° K. The present invention is not limited to the embodiments described above. The similar results were obtained when the wall load of the lamp were changed within the range of 25 to 45 W/cm$^2$. The lamp of the present invention may have the wall load of more than 45 W/cm$^2$. Further, the lamp of the present invention may have a base at each end of the lamp.

The present invention has been described with respect to a specific embodiment. However, other embodiments based on the principles of the present invention should be obvious to those of ordinary skill in the art. Such embodiments are intended to be covered by the claims.

What is claimed is:

1. A metal halide lamp, comprising:
   - a discharge glass tube defining a discharge space;
   - a pair of electrodes provided in the discharge glass tube for generating a discharge therebetween;
   - mercury in the glass tube for generating the discharge;
   - halogen fillings comprising bromine and iodine contained in the discharge glass tube, the mol ratio of the bromine to the halogen fillings being not less than 0.3; and
   - metals reacting with the halogen and emitting light in the discharge glass tube by the discharge, the metal comprising tin, sodium, thallium and indium, the tin being contained in the discharge glass tube in an amount of 1 to 14 μ·mol per 1 cc of discharge space, each mol ratio of the amount of the sodium, the thallium and the indium to the amount of the tin being not less than 0.2.

2. The metal halide lamp according to claim 1, further comprising an outer glass tube surrounding the discharge glass tube.

3. The metal halide lamp according to claim 2, further comprising a pair of outer electric power receiving means provided to the outer glass tube for receiving and supplying electric power to both of the electrodes.

4. The metal halide lamp according to claim 3, further comprising a pair of electric connection means provided to the discharge glass tube for connecting electrically both of the electrodes with both of the outer electric power receiving means.

5. The metal halide lamp according to claim 4, wherein the discharge has a discharge direction, the pair of outer electric power receiving means are positioned at one side of the discharge glass tube which includes an end in a direction perpendicular to the discharge direction and the pair of electric connection means are positioned at one side of the outer glass tube which includes an end in a direction perpendicular to the discharge direction.

6. The metal halide lamp according to claim 1, wherein the discharge has a wall load of at least 25 $W/cm^2$ inner surface area of the discharge glass tube.

7. The metal halide lamp according to claim 6, wherein the wall load is less than or equal to 45 $W/cm^2$.

8. The metal halide lamp according to claim 1, wherein each mol ratio of the amount of the sodium, the thallium and the indium to the amount of the tin is not more than 0.9.

9. The metal halide lamp according to claim 8, wherein the tin is contained in the discharge glass tube at the amount of not less than 5.0 $\mu$·mol per 1 cc of discharge space.

10. The metal halide lamp according to claim 9, wherein the mol ratio of the bromine to the halogen fillings is not more than 0.7.

11. A lighting system for a metal halide lamp, comprising:

a discharge glass tube defining a discharge space;

a pair of electrodes provided in the discharge glass tube for generating a discharge therebetween;

mercury in the glass tube for generating the discharge;

halogen fillings comprising bromine and iodine contained in the discharge glass tube, the mol ratio of the bromine to the halogen fillings being 0.3 to 0.7;

metals reacting with the halogen and emitting light in the discharge glass tube by the discharge, the metal comprising tin, sodium, thallium and indium, the tin being contained in the discharge glass tube in an amount of 1 to 14 $\mu$·mol per 1 cc of discharge space, each mol ratio of the amount of the sodium, the thallium and the indium to the amount of the tin being not less than 0.2; and means for supplying electric power to generate the discharge having a wall load of at least 25 $W/cm^2$ inner surface area of the discharge glass tube.

12. The lighting system according to claim 11, wherein the wall load is less than or equal to 45 $W/cm^2$.

13. The lighting system according to claim 11, wherein each mol ratio of the amount of the sodium, the thallium and the indium to the amount of the tin is not more than 0.9.

14. The lighting system according to claim 13, wherein the tin is contained in the discharge glass tube at the amount of not less than 5.0 $\mu$·mol per 1 cc of discharge space.

15. The lighting system according to claim 14, wherein the mol ratio of the bromine to the halogen fillings is not more than 0.7.

* * * * *